US005179864A

United States Patent [19]

Ueta et al.

[11] Patent Number: 5,179,864

[45] Date of Patent: Jan. 19, 1993

[54] STARTER HAVING A CONTAMINANT-PROOF STRUTURE OF A SLIDING PORTION

[75] Inventors: Koki Ueta, Katsuta; Naoki Kamada, Mito; Hideo Mori; Suehiro Endo, both of Naka; Susumu Tajima, Katsuta, all of Japan

[73] Assignees: Hitachi, Ltd., Tokyo; Hitachi Automotive Engineering Co., Ltd., Ibaraki, both of Japan

[21] Appl. No.: 523,402

[22] Filed: May 15, 1990

[30] Foreign Application Priority Data

May 24, 1989 [JP] Japan ..... 1-128777

[51] Int. Cl.[5] ..... F02N 11/02

[52] U.S. Cl. ..... 74/7 A; 74/7 C; 74/7 R; 290/38 A

[58] Field of Search ..... 74/6, 7 A, 7 C, 7 R; 290/38 A

[56] References Cited

U.S. PATENT DOCUMENTS

| | | | |
|---|---|---|---|
| 4,592,243 | 6/1986 | Katoh et al. | 74/7 R X |
| 4,748,862 | 6/1988 | Johnston | 74/7 R |
| 4,895,035 | 1/1990 | Okamoto et al. | 74/7 A |
| 4,899,604 | 2/1990 | Morishita et al. | 74/7 A |
| 4,926,631 | 5/1990 | Sorenson | 74/7 C X |
| 4,953,414 | 9/1990 | Ueno et al. | 74/6 |
| 4,995,275 | 2/1991 | Okamoto et al. | 74/7 A |
| 5,000,054 | 3/1991 | Morishita et al. | 74/6 |
| 5,052,234 | 10/1991 | Sugiyama | 74/7 R X |
| 5,054,329 | 10/1991 | Morishita et al. | 74/7 A X |

FOREIGN PATENT DOCUMENTS

| | | |
|---|---|---|
| 61-1864 | 1/1986 | Japan . |
| 64-29270 | 2/1989 | Japan . |

*Primary Examiner*—Leslie A. Braun
*Assistant Examiner*—Julie Krolikowski
*Attorney, Agent, or Firm*—Antonelli, Terry, Stout & Kraus

[57] ABSTRACT

A contaminant proof structure for a starter for an engine, with the starter including a sliding portion between a sliding member and a support member supporting the sliding member disposed in a housing so that the sliding member can project into the outside of the housing through an opening formed in a wall of the housing. An atmospheric gas reservoir disposed in the housing between the support member and the wall of the housing around the opening, and a communication passage bypasses the sliding portion and communicates the atmospheric gas reservoir with an external atmospheric gas through a space at an opposite side of the support member to the atmospheric gas reservoir side. The sliding member is dimensioned such that a gap between the opening and the sliding member inserted in the opening is small.

15 Claims, 5 Drawing Sheets

STARTER HAVING A CONTAMINANT-PROOF STRUTURE OF A SLIDING PORTION

BACKGROUND OF THE INVENTION

This invention relates to a starter for starting an engine such as an automobile internal combustion engine and, more particularly, to a structure for preventing a sliding portion of the starter from being contaminated with dust, water, brine, etc., and from rust occurrence, and a starter employing such a structure.

In general, a conventional starter for starting engines comprises a motor, a motor housing, a pinion shaft disposed in the motor housing and slidably supported by a ball bearing, and a mechanism including a clutch for connecting an output shaft of the motor and the pinion shaft and for projecting the pinion shaft out of the motor housing to engage with a ring gear in a transmission casing of the engine to thereby rotate the ring gear and start the engine.

In a conventional starter of this type, as described in Japanese Patent Laid-Open No. 61-1864, for example, the motor housing is simply cylindrically formed around the peripheral portion of the pinion shaft, and the ball bearing for rotatably and slidably supporting the pinion shaft is fixed to the motor housing. The pinion shaft is provided with a stepped portion at its outer periphery and inserted into the ball bearing so that the stepped portion of the pinion shaft abuts the side face of the ball bearing.

Provision of the step portion of the pinion gear abutting the ball bearing is to prevent entry of brine, dust, etc., into the sliding portion between the ball bearing and the pinion shaft so that rust occurrence will be prevented and a smooth sliding operation will be carried out.

The mechanism which accomplishes rust-proofing and dust-proofing by employing the conventional technique described above cannot completely cut off the invasion of brine, dust, etc., in an atmospheric gas when a pressure inside the transmission case rises and dirty atmospheric gas inside the transmission case flows into the motor housing. Thus, if this starter is used for several years, the sliding operation of the pinion shaft is adversely affected eventually leading to a seizure of the pinion shaft onto the bearing sliding surface. Further, in the conventional structure described above, after assembling of the clutch, the pinion shaft and the ball bearing into the motor housing, it is necessary to fix the ball bearing to the motor housing. Therefore, it is difficult to assemble the starter and the conventional technique cannot be easily applied to practical application.

Another construction is disclosed in Japanese Utility Model Laid-Open No. 64-29270 which was laid-open on Feb. 21, 1989. This construction has an air space at one side of a bearing supporting a movable pinion shaft and an opening which is formed in a front frame through which a pinion of the pinion shaft projects out of the machine frame. A radially inwardly extending flange portion is formed at the opening to provide a small clearance between an outer periphery of the pinion and the opening. The flange portion has a adjacent relation to a shoulder portion of the pinion shaft when the pinion projects outside the frame whereby a clearance between the opening and the pinion is reduced at the opening when the pinion shaft is projected outwardly of the frame.

The above construction is further provided with a drain passage for enabling a discharge of a liquid entering through the clearance into a transmission casing. Even with the above-mentioned construction, a problem resides in the fact that pressure in the air space increases over a given time period so that air in the space is likely to penetrate into a sliding portion between the pinion shaft and the bearing and contaminate the sliding portion with dust, water, brine etc. contained in the air.

SUMMARY OF THE INVENTION

An object of the present invention is to provide a contaminate-proof structure wherein a sliding member, a support member for slidably supporting the sliding member and a structure for driving the sliding member can be assembled easily into a housing, and wherein occurrence of rust on a sliding surface or bearing portion of the support member is minimized.

According to the present invention, a contaminant-proof structure is provided for preventing adhesion of contaminants such as dust, brine, etc., to a sliding portion of an apparatus which results in a hampering of a smooth sliding operation of the sliding portion. The apparatus has a sliding member, disposed in a housing and supported by a support so that one end of the member is projectable out of the housing through a hole or opening made in the housing. The contaminant-proof or sliding portion prevention structure comprises dimensional shapes of the housing opening and the end portion of the sliding member, formed so that a gap defined between the housing opening and the end portion of the sliding member inserted in the housing opening has a reduced dimension, and a gas reservoir is formed between the support member and a wall of the housing at the opening, with the gas reservoir having a volume sufficient to reduce a speed of a gas flow passing through the gap between the housing opening and the end portion of the sliding member inserted therein. A communication passage bypasses the sliding surface of the support member and communicates the gas reservoir and a space at an opposite side of the sliding member to the gas reservoir side.

Preferably, the volume of the gas reservoir is sufficient to accommodate the gas entering the gas reservoir through the gap so that the gas in the gas reservoir is substantially stationary.

The communication passage is preferable to bypass the sliding portion of the support member and communicate with spaces at both sides of the support member such as a bearing supporting the sliding member over the sliding portion so that the pressure at both sides of the support can be made substantially equal and the sliding portion of the support member is not contaminated with dust and brine, etc..

A typical example of an apparatus employing such a sliding portion prevention structure as mentioned above is a starter for engines.

According to the present invention, a starter is provided which includes a housing, a motor having an output shaft disposed in the housing, a rotatable shaft having a pinion formed at one end thereof, a support member for rotatably and axially slidably supporting the rotatable shaft, and a mechanism for connecting the rotatable shaft to the output shaft of the motor and for projecting the rotatable shaft out of the housing through a hole formed in the housing to mesh with the pinion and a gear in a transmission casing of the engine to drive the engine. An air reservoir is formed between a wall of the housing in which the opening is formed and one side of the support member opposing the wall of the housing, and a communication passage is provided for communicating the air reservoir and the outside of the housing through a space at an opposite side of the support member to the reservoir.

A termination of pinion teeth formed in the pinion shaft is disposed between the opposite ends thereof, and preferably, the tooth termination faces an inner peripheral surface of the housing wall forming the opening when the pinion projects out of the housing whereby an amount of air entering the housing at the opening is reduced.

DETAILED DESCRIPTION OF THE INVENTION

While the embodiment of the invention will be described in connection with a starter, often used in adverse conditions, employing a structure for preventing a sliding portion of an apparatus from adhesion of substances such as dust, brine, etc., hampering a smooth operation of the sliding portion, it is understood that the present invention is not limited to the starter and the portions relating to the invention can of course be applied to apparatuses in general which have the structure as mentioned above.

Figure 1:
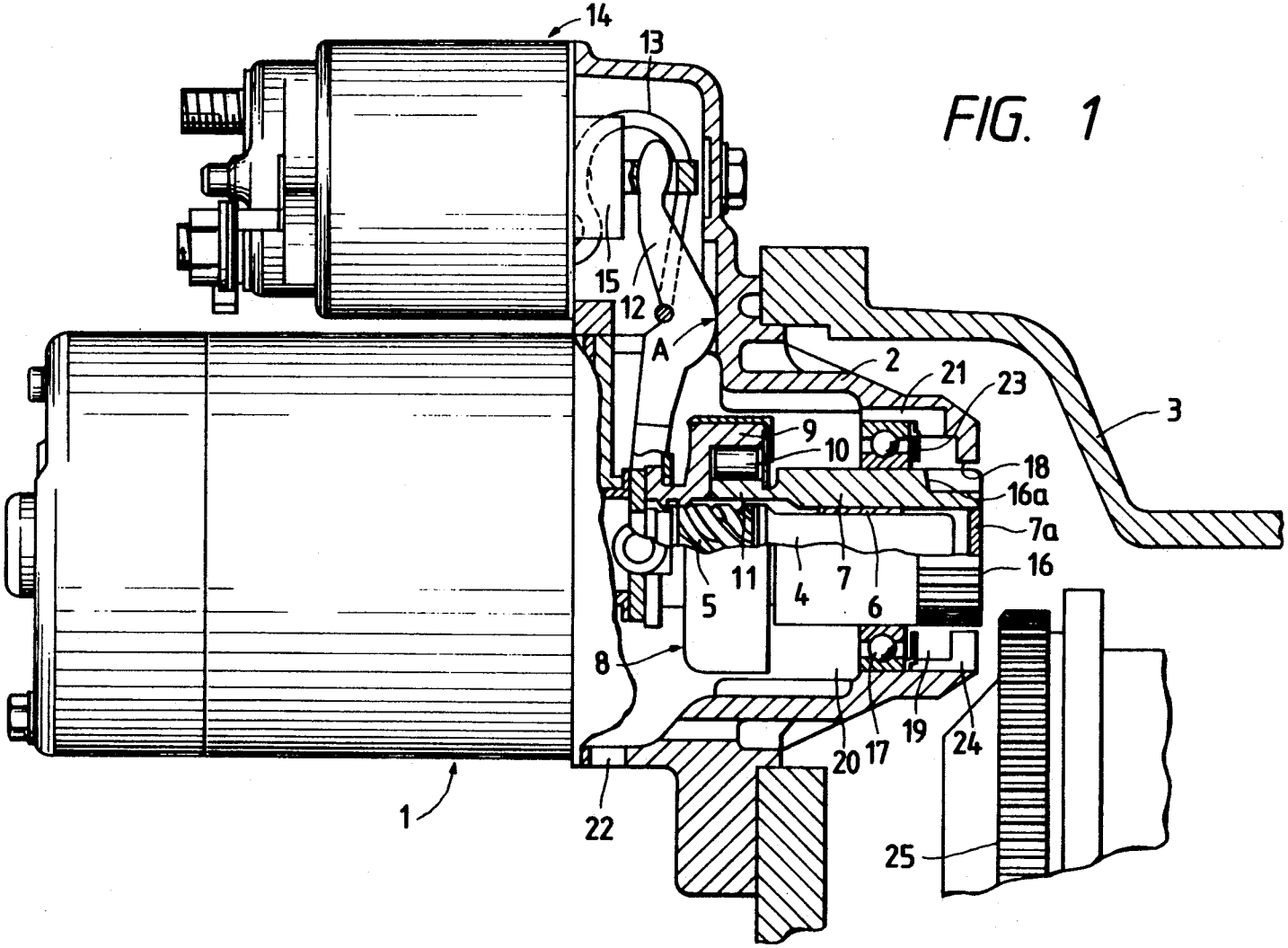
FIG. 1 is a sectional view of an embodiment of a starter in accordance with the present invention.

Referring now to the drawings wherein like reference numerals are used throughout the various views to designate like parts and, more particularly, to FIG. 1 according to this figure, a starter generally designated by the reference numeral 1 includes a motor housing 2 fixed to a transmission casing 3 of an engine such as an internal combustion engine for automobiles so that a part of the housing 2 projects into the transmission casing 3. A motor (not shown) is disposed in the housing and includes an output shaft 4 projecting toward the transmission casing 3. The output shaft 4 is formed with a helical spline 5 at an intermediate part thereof. A hollow pinion shaft 7 has a pinion 16 formed at an end, with one end of the hollow pinion shaft 7 being closed by a plate 7a fixed thereto and the other end being opened. The hollow pinion shaft 7 is fitted, from the open end side to the tip portion of the output shaft 4 through a metal bearing 6 in such a manner so as to be capable of rotating and sliding in an axial direction.

The hollow pinion shaft 7 and the motor output shaft 4 are integrally coupled by a one-way clutch 8, and the clutch outer member 9 of this one-way clutch 8 is disposed around the outer periphery of the helical spline 5 of the output shaft 4. A roller 10 of the one-way clutch 8 is stored in a wedge-shaped gap defined between the clutch outer member 9 and the outer periphery of the open end portion 11 of the hollow pinion shaft 7, so that when the clutch outer member 9 moves to the right in FIG. 1 and rotates to follow up the rotation of the output shaft 4 through the spline coupling, the roller 10 integrally couples the clutch outer member 9 and the hollow pinion shaft 7.

The clutch outer member 9 is axially shifted by a shift lever 12, with one end of the shift lever 12 being connected to the clutch outer member 9 and the other end of the shift lever 12 being connected to a plunger 15 of an electromagnetic switch 14. The shift lever 12 is urged against a wall of the motor housing 2 by a force of a torsion spring 13. The outer periphery surface of the pinion shaft 7 (hereinafter referred to as a sliding surface) is slidably supported in the axial direction by a ball bearing 17 which is press-fitted into and fixed to the motor housing 2. The ball bearing 17 also has a sliding surface for slidably supporting the pinion shaft 7.

The motor housing 2 has an opening 18 for enabling a projection of the pinion shaft 7 out of the motor housing 2. The inner diameter of the opening 18 is somewhat greater than the outer diameter of the sliding surface of the pinion shaft 7, that is, the inner diameter of the opening 18 and the outer diameter of the pinion shaft 7 are substantially the same. A dimensional relationship between the pinion 16 formed in the pinion shaft 4 and the wall thickness of the motor housing 2 defining the opening 18 is selected so that when the pinion shaft 7 projects from the opening 18 into the transmission casing 3, the termination or final edge 16a of the gear tooth of the pinion 16 faces the inner peripheral surface of the opening 18, whereby an air passage area is formed between the pinion shaft end portion inserted in the opening 1, which air passage area is very small when the pinion shaft 7 projects through the opening 18 into the transmission casing 3.

The motor housing 2 is shaped to form a ring-like atmospheric gas reservoir 19 such as an air reservoir between the side of the ball bearing 17 and the wall of the motor housing 2 at the side of the opening 18. The reservoir 19 functions in such a manner that a speed of the air flow passing through the air gap between the opening 18 and the pinion shaft 7 inserted in the opening 18 and entering the reservoir 19 is reduced. Preferably, the air flow becomes substantially stationary in the reservoir 19.

The motor housing 2 has a clutch storage chamber 20 at the opposite side to the reservoir 19 with respect to the ball bearing 17. The reservoir 19 communicates with the clutch storage chamber 20 through a communication passage 21. This communication passage 21 is disposed at a position which bypasses the sliding surface of the ball bearing 17, that is, at the position above the ball bearing 17 which is on the opposite side to the sliding surface of the ball bearing 17. The clutch storage chamber 20 is communicated with the external air by a gap, not shown; however, in order to insure reliable communication with the external air, an external communication port 22 may be bored in the motor housing 2.

Figure 3:
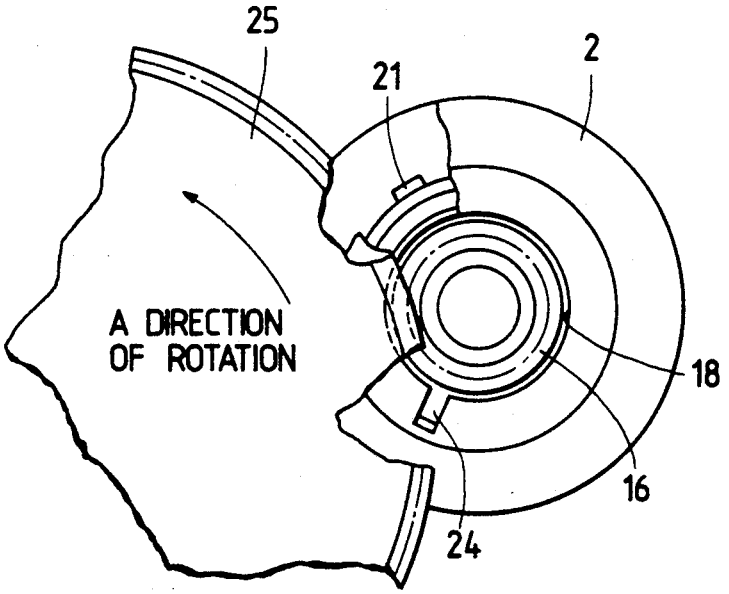
FIG. 3 is a front view of a part of the starter shown in FIG. 1.

A ring-like partition 23 of, for example, a stainless sheet, is disposed on the side surface of the ball bearing 17 on the side of the opening 18, that is, on the side surface on the side of the reservoir 19, and a notch groove 24 (FIG. 3) is disposed downwardly in the gravitational direction at the opening 18.

A ring gear 25 is disposed outside of the motor housing 2 and inside the transmission case 3, with the ring gear 25 meshing with the pinion 16 and being rotatably driven by the motor, so as to start the engine.

Instead of the motor housing, a housing may be made independent of the motor and fixed to the motor so that an output shaft is disposed in the housing.

Figure 2:
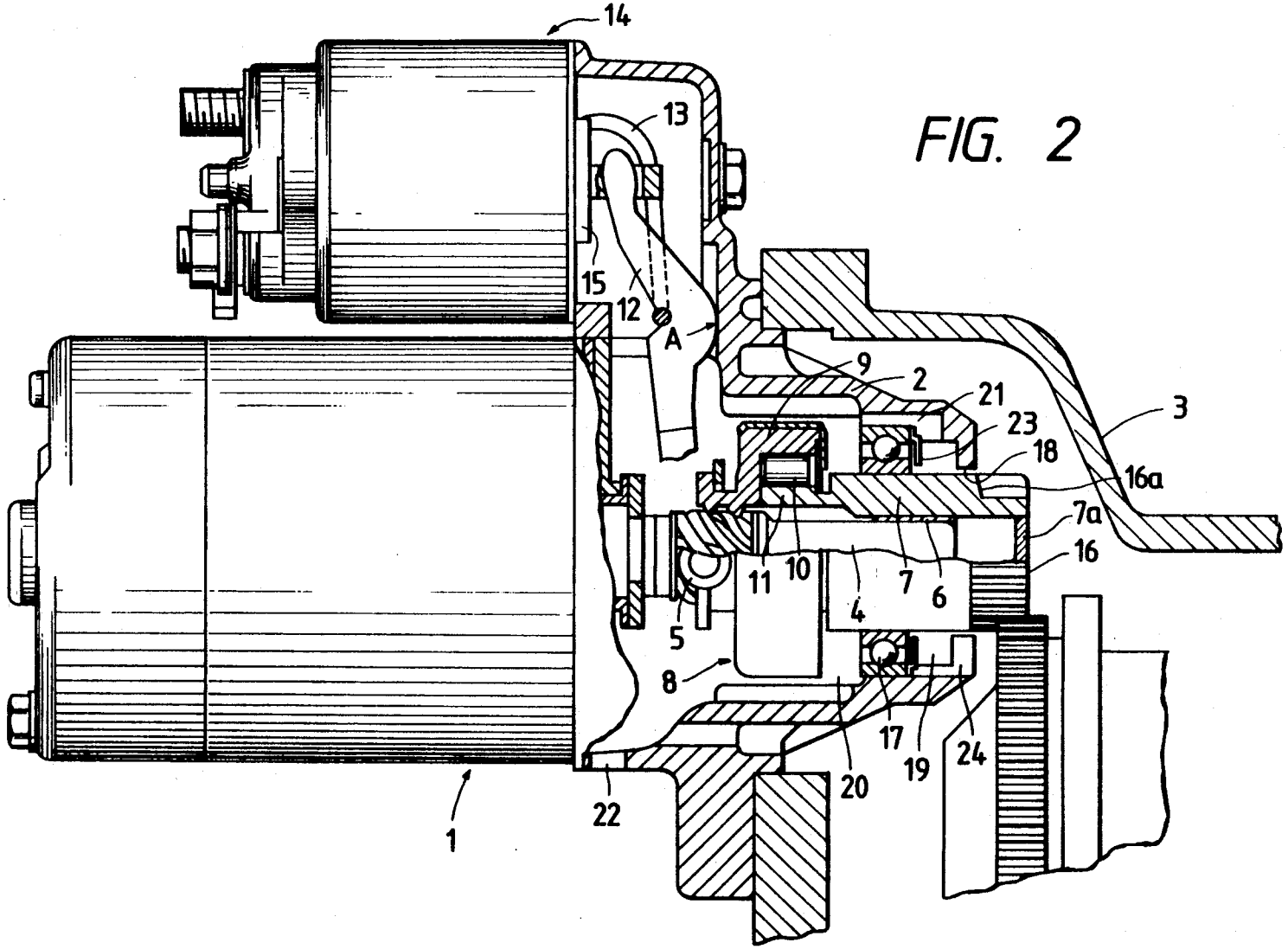
FIG. 2 is a sectional view showing the starter of FIG. 1 in a state in which a pinion meshes with a ring gear to start the engine.

A starter switch (not shown) is turned ON when the engine is to be started by the starter I. Then, the electromagnetic switch 14 is turned ON and the plunger 15 is attracted into the electromagnetic switch 14 as shown in FIG. 2. Upon the attraction of the one end of the shift lever 12 by the plunger 15, the shift lever 12 rotates about a contact point A with the motor housing 2 as the fulcrum, whereby the other end of the shift lever 12, connected to the clutch outer member 9, is moved to the right and the pinion 16 projects from the opening 18 into the transmission casing 3 and meshes with the ring gear 25. As the starter switch is turned ON, power is supplied to the motor and the output shaft 4 starts rotating. Due to both of these operations, the one-way clutch 8 is actuated, the pinion shaft 7 starts rotating integrally with the motor output shaft 4 and the ring gear 25 is driven for rotation.

Figure 4:
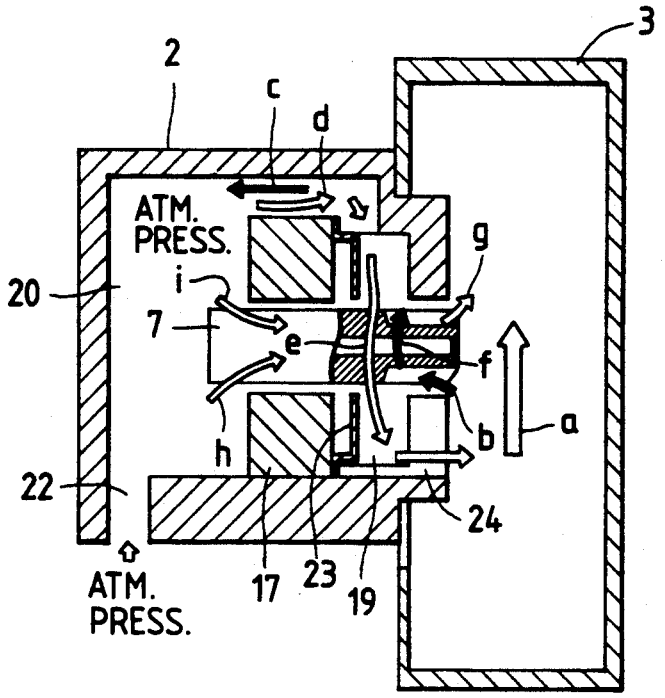
FIG. 4 is a schematic view for explaining the condition of air flow inside the starter shown in FIG. 1.
Figure 5:
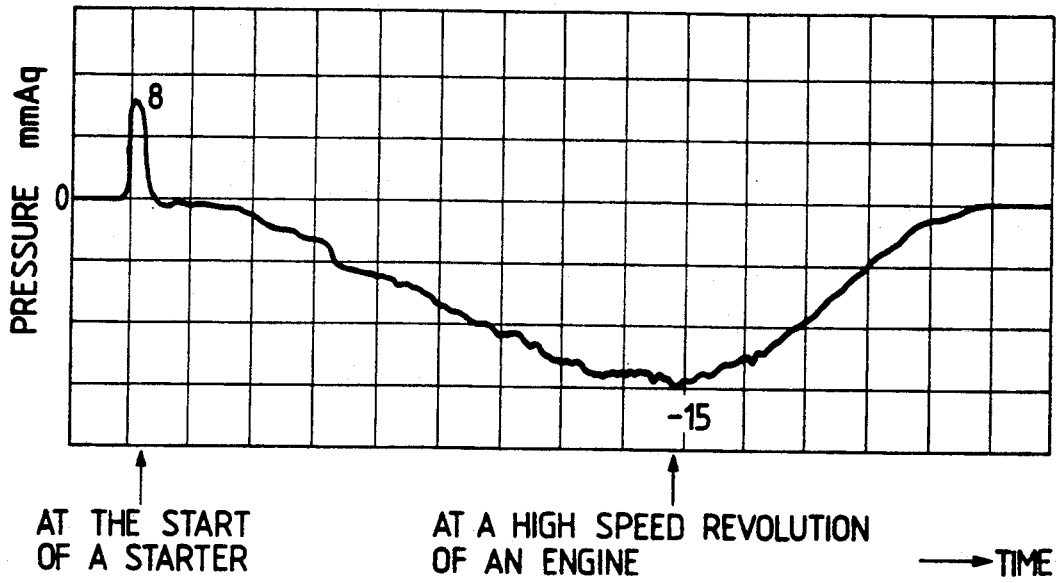
FIGS. 5 and 6 are graphical illustrations of experimental data of a conventional starter.

When the ring gear 25 starts rotating at the start of the engine, as shown in FIG. 4, an accompanying rotating gas flow a, caused by the rotation of the ring gear 25, is prevented from advancing at the meshing position between the ring-gear 25 and the pinion gear 16 and is about to flow into the starter 1, that is, into the motor housing 2, through the gap between its opening 18 and the pinion shaft 7. This inflowing gas flow b raises the pressure inside the reservoir 19. However, the dimensions and shapes of the opening 18, the pinion shaft 7 and the gear tooth termination 16*a* (FIG. 2) of the pinion 16 are determined so that the gap described above becomes extremely small. Therefore, this inflow is limited and the rise of the pressure inside the reservoir 19 is limited. Further, the inflowing gas flow b is decelerated to be substantially stationary when it enters the reservoir 19, and detrimental dust and water are collected in the reservoir 19. The dust and water staying in the reservoir 19 return into the transmission casing 3 through the notch groove 24.

The air flow that flows into the reservoir 19 enters the substantially stationary state but, if it is left as such, the pressure inside the reservoir 19 increases. However, the air inside the reservoir 19 enters the clutch storage chamber 20 through the passage 21 as shown by the arrow c. In other words, the dirty air inside the transmission casing 3 that flows into the motor housing 2 flows into the clutch storage chamber 20 without contaminating the sliding surface of the ball bearing 17. The air which flows into the reservoir 19 in such a direction so as to impinge directly against the ball bearing 17 is checked by the partition 23. In other words, the dust and water do not directly contaminate the ball bearing 17 and the sliding surface.

After the start of the engine, the starter switch is turned OFF. Accordingly, the supply of power to the motor is cut off, the pinion 16 stops rotating, the electromagnetic switch 14 is deenergized, the shift lever 12 is released from the attraction by the plunger by the force of the spring, and the pinion 16 disengages from the ring gear 25 and is returned into the motor housing 2.

When the rotational speed of the engine increases, the flow velocity of the accompanying rotational air flow a becomes high. Therefore, the pressure near the opening 18 of the motor housing 2 becomes lower than the pressure of the reservoir 19 according to Bernoulli's law, and the air inside the reservoir 19 is suctioned out from the transmission casing 3 side and the interior of the reservoir 19 attains a negative pressure. Accordingly, a gas flow d results as the external air inside the clutch storage chamber 20 flows into the reservoir 19 through the passage 21. This air flow d becomes an air flow e which flows from the high pressure portion near the passage 21 inside the air reservoir 19 to the low pressure portion near the notch groove 24. Accordingly, the interior of the reservoir 19 is filled with fresh and clean air and this air flow e pushes back the inflowing air flow b so that this air flow b is turned into the air flows f and g and is returned into the transmission casing 3. The air flow e flows out into the transmission casing 3 from the notch groove 24.

When the rotational speed of the engine further increases, the pressure inside the air reservoir 19 further drops and the operation of the air flows described above becomes more vigorous. Furthermore, the external air of the clutch storage chamber 20 generates air flows h and i that flow into the reservoir 19 through the gap between the ball bearing 17 and the pinion shaft 7 and these air flows h, i purge the dust and water that attempt to enter the sliding surface from the reservoir 19.

Figure 6:
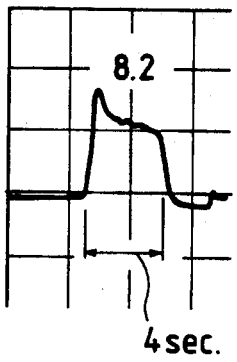

Next, the effect of the invention will be explained by actual experimental data of the invention and a conventional starter. The conventional starter is a starter which is not equipped with the reservoir 19 and the passage 21 and the experimental data takes into account the pressure change near the ball bearing 17 when the rotational speed of the engine is increased to a high speed from an idle condition after the start operation of the engine and is again returned to the idle condition. According to the experimental data, a positive pressure of 8 mmAq occurs at the start of the starter and a negative pressure becomes greater with the increase in the rotational speed of the engine and a maximum negative pressure of −15 mmAq occurs. FIG. 6 shows the pressure change when the starter switch is kept ON for four seconds, for example, in order to start this conventional starter. In this case, it can be understood that the inflow of the air flow b shown in FIG. 4 continues and the positive pressure state continues.

Figure 7:
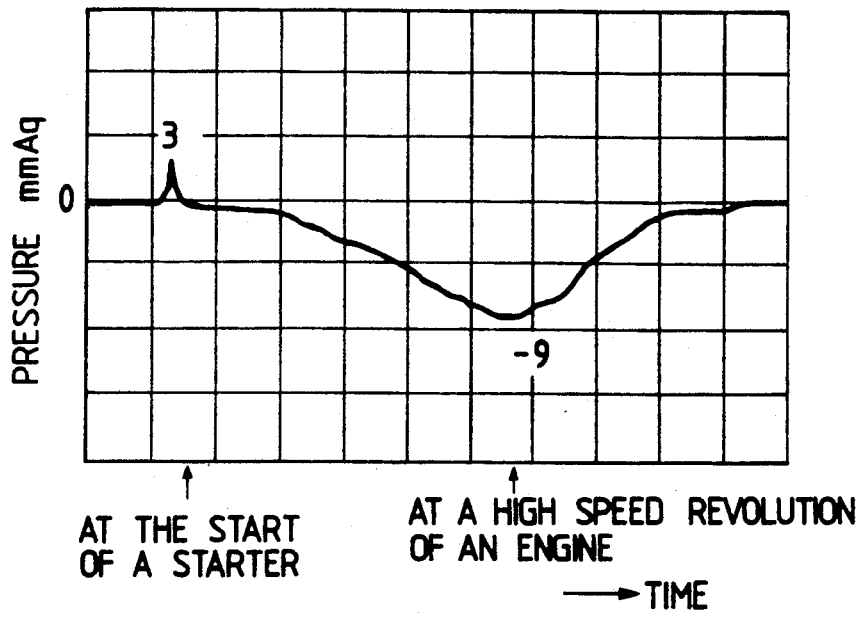
FIGS. 7 and 8 are graphical illustrations of experimental data of the starter shown in FIG. 1.

FIG. 7 shows the pressure change in the reservoir 19 in the invention. In the invention, the pressure becomes a positive pressure at the start of the starter, but a value of the pressure is 3 mmAq. In other words, the inflow of the air flow b is less by the reducing of the positive pressure value than the conventional starter and the inflow quantity of the dust and water becomes smaller. In the case of the conventional starter, the possibility of contamination of the sliding surface becomes higher if the ON state of the starter switch is kept for a longer period of time but in the case of the invention, the absolute value of the positive pressure itself is small and the possibility of contamination of the sliding surface is therefore small even when the ON state of the starter switch is kept for a long time period.

With the invention, even when the rotational speed of the engine rises and the pressure inside the reservoir 19 becomes a negative pressure, its maximum value is −9 mmAq. This means that even when the air inside the reservoir 19 is suctioned out by the accompanying rotating air flow a, there is the air flow d of the external air that flows into the reservoir 19 through the passage 21. In other words, the air flow d prevents the dirty air inside the transmission casing 3 from flowing into the reservoir 19 and reaching the sliding surface.

Figure 8:
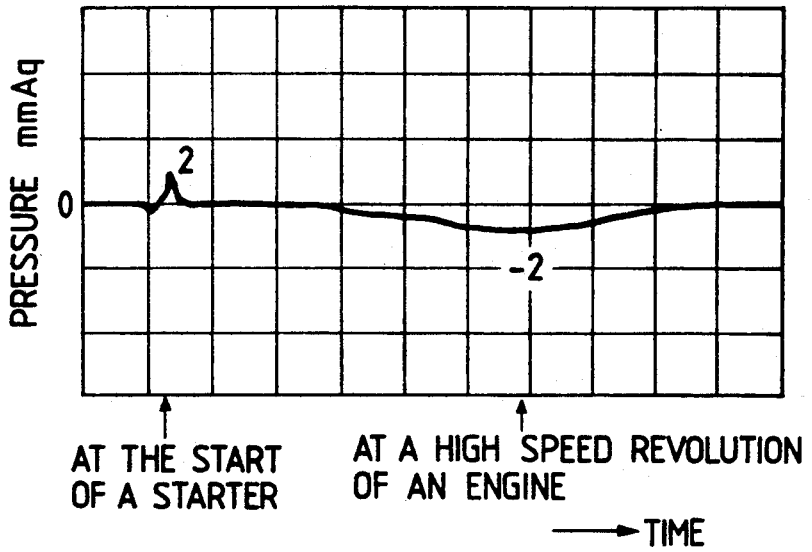

FIG. 8 shows the experimental data obtained by collecting the pressure change on the side surface portion of the ball bearing 17 among the reservoir 19 simultaneously and in parallel with the experimental data of FIG. 7. According to this experimental data, the positive pressure of 2 mmAq occurs at the time the starter switch is in an ON position and the negative pressure of −2 mmAq occurs at the time of high rotational speed of the engine. This fact represents the air flows c and d flowing through the passage 21. As a result of acceleration tests, the starter of this embodiment is confirmed to retain the sliding surface under the good conditions and to be free from any defect for at least six years and this is brought forth as the synergistic effect of the disposition of the reservoir 19 and the disposition of the passage 21 which generates the air flows c, d represented by the experimental data described above.

As described above, in accordance with the invention, the rise of the positive pressure near the sliding surface at the time of the start of the engine is restricted, the pressure difference between the pressure inside the motor housing 2 and the pressure inside the transmission case 3 is regulated and the pressure gradient between them is brought to substantially zero. Accordingly, the entrance of the dirty air inside the transmission casing 3 into the motor housing 2 is restricted and the sliding surface is prevented from being contaminated by the dust or rusted by invasion of brine. Since an air flow is generated that pushes back the dirty air which is about to flow into the sliding surface by the clean air at the time of driving of the engine, the sliding surface can be kept likewise under good conditions.

Incidentally, the above-described embodiment of the invention is equipped with three elements, that is, the disposition of the reservoir 19, the use of the dimensional shape for limiting the air flow under a and the disposition of the passage 21, but the present invention is not limited thereto, and, for example, disposition of only the reservoir 19 and the passage 21 can provide the dust-and rust-proofing effect, as apparent from the experimental data of the invention described above.

The present invention is not limited to the starter described above but when applied to machinery in general equipped with a sliding member analogous to the slidable pinion shaft described hereinabove, the present invention can prevent entrance of the dust and the like into the sliding portion.

What is claimed is:

1. A starter for engines, the starter comprising:

a housing;

a motor having an output shaft disposed in said housing;

a rotatable shaft having a pinion formed at one end thereof;

a support member disposed in said housing for supporting said rotatable shaft rotatably and slidably in an axial direction thereof;

a mechanism for connecting said rotatable shaft to said output shaft of said motor and for projecting said rotatable shaft outside said housing through an opening formed in said housing to cause said pinion of said rotatable shaft to mesh with a gear located exteriorly of said housing to start the engine, wherein a small gap is formed between the opening formed in said housing and said end of said rotatable shaft inserted in said opening, an air reservoir is formed between a wall of said housing in which said opening is formed and one side of said support member opposing said housing wall, and a communication passage is provided for communicating said air reservoir and on the outside of said housing through an opposite side of said support member to a reservoir side thereof.

2. A starter according to claim 1, wherein said support member includes a bearing fixed to said housing for rotatably slidably supporting said rotatable shaft.

3. A starter according to claim 2, wherein said pinion includes a final tooth edge between respective ends of said rotatable shaft, and said final tooth edge faces an inner periphery of said opening within a width of said wall of said housing, whereby a small gap for a passage of air is defined between said opening of said housing and said rotatable shaft inserted into said opening to thereby restrict an air inflow into said housing.

4. A starter according to claim 3, wherein said communication passage bypasses a sliding surface of said support and communicates with spaces at both sides of said support member with respect to the axial direction, and wherein one of said spaces forms said air reservoir, whereby pressure at both sides of said support member is substantially equal.

5. A starter according to claim 4, wherein said communication passage bypasses a sliding surface of said bearing through an upper portion of said housing over said bearing in a gravitational direction.

6. A starter according to claim 5, wherein said housing includes a notch groove in the wall of the housing under said opening communicating with said opening so that contaminative substances contained in air entering said air reservoir at said opening escapes through said notch groove.

7. A starter according to claim 3, wherein a partition is provided on one side of said bearing at a side of said air reservoir for preventing impingement of air flowing in said housing through said gap between said openings said housing and said rotatable shaft inserted in said opening, on said bearing, to thereby prevent exposure of a sliding portion of said bearing to contaminative substances.

8. A starter for starting internal combustion engines, said starter comprising:

a motor;

a housing containing said motor;

a pinion shaft disposed in said housing, one end of said pinion shaft having a pinion formed thereon, teeth of said pinion extend from said one end toward an opposite end of the pinion shaft and terminate in a final tooth edge disposed between the first and opposite ends of said pinion shaft;

a bearing disposed in and fixed to said housing and rotatably and axially slidably supporting said pinion shaft;

a mechanism disposed in said housing for connecting said pinion shaft to said motor and for projecting said pinion of said pinion shaft out of said housing through an opening formed in a side wall of said housing so that said pinion engages with a ring gear in a transmission casing of the engine upon a starting of the engine;

wherein said final tooth edge of said pinion shaft perpendicularly faces an inner peripheral surface of said side wall defining said opening when said pinion is projected out of said housing, so that an air gap between said pinion shaft and said opening of said housing is restricted;

an air reservoir formed between said side wall of said housing and one side of said bearing opposite to said side wall, said air reservoir having a volume sufficient to reduce a flow speed of air passing through said gap regardless of a relative position of said pinion shaft to said opening of said housing; and a communication passage communicating with spaces provided at both sides of said bearing, one of said spaces forming said air reservoir, and wherein said communication passage bypasses a sliding surface of said bearing and communicates with an exterior of said housing.

9. A starter according to claim 8, wherein said communication passage bypasses said sliding surface of said bearing at an upper side of said bearing, and a passage, independent from said communication passage, is formed in an under side of said opening of said housing for communicating a lower part of said air reservoir and an exterior of said housing.

10. A starter according to claim 9, wherein a partition is provided on an air reservoir side of said bearing for preventing a sliding portion of said bearing from adhesion of solid and/or liquid substances on said sliding portion.

11. In a starter for an engine provided with a pinion shaft enclosed in a housing and having a pinion at one end, said pinion shaft being supported by a bearing and being slidable in an axial direction to project into a transmission casing through an opening of said housing and mesh with a ring gear inside said transmission casing when the engine is started, the improvement comprising:

an air reservoir defined between said bearing and said opening of said housing for storing air admitted therein through said opening; and a communication passage for communicating said air reservoir with an exterior of said air reservoir.

12. A starter according to claim 11, wherein said communication passage communicates said air reservoir with an external air chamber defined in said housing at an opposite side of said bearing to an air reservoir side to thereby reduce a pressure differential between both the sides of said bearing to prevent air from flowing through a gap between said pinion shaft and said bearing.

13. A starter according to claim 12, further including a partition for partitioning said bearing and said air reservoir on a side surface of said bearing.

14. In a starter for an engine provided with d pinion shaft enclosed in a housing and having a pinion at one end, said pinion shaft being supported by a bearing and being slidable in an axial direction to project into a transmission casing through an opening of said housing and mesh with a ring gear inside said transmission casing when the engine is started, the improvement comprising:

an air passage for guiding an air flow generated by a rotation of said ring gear meshing with said pinion to bypass a slidably supporting portion of said bearing and to flow from said opening into an external air chamber formed in said housing at an opposite side of said bearing to said opening side, said passage having a cross-sectional area sufficient to make the air flow substantially stationary between said opening and said bearing.

15. A starter according to claim 14, wherein a partition is provided so as to prevent the air flow from flowing into said bearing from said opening.

* * * * *